US006195853B1

(12) United States Patent
Kim

(10) Patent No.: US 6,195,853 B1
(45) Date of Patent: Mar. 6, 2001

(54) SHEARING DEVICE

(76) Inventor: Jin Tae Kim, 427 Thompson #5, Glendale, CA (US) 91201

( * ) Notice: Subject to any disclaimer, the term of this patent is extended or adjusted under 35 U.S.C. 154(b) by 0 days.

(21) Appl. No.: 09/535,448

(22) Filed: Mar. 24, 2000

(51) Int. Cl.[7] ..... D06C 13/00
(52) U.S. Cl. ..... 26/15 R; 26/7
(58) Field of Search ..... 26/15 R, 7, 16, 26/18, 15 FB, 2 R, 8 R, 11, 13; 30/208, 209, 210, 173, 214, 241, 223, 133

(56) References Cited

U.S. PATENT DOCUMENTS

| | | | | |
|---|---|---|---|---|
| 238,353 | * | 3/1881 | Coates | 26/7 |
| 2,088,162 | * | 7/1937 | Cook | 25/7 |
| 2,356,378 | * | 8/1944 | Capolupo | 26/7 |
| 2,360,557 | * | 10/1944 | Freimark | 26/15 R |
| 2,387,579 | * | 10/1945 | Griffin et al. | 26/15 R |
| 2,513,119 | * | 6/1950 | Stout | 26/7 |
| 2,584,620 | * | 2/1952 | Rubin | 26/7 |
| 2,950,530 | * | 8/1960 | Fox | 30/209 |
| 3,279,023 | * | 10/1966 | Zobel | 26/7 |
| 5,285,558 | * | 2/1994 | Carder et al. | 26/7 |

FOREIGN PATENT DOCUMENTS

| | | | | |
|---|---|---|---|---|
| 402061169 | * | 3/1990 | (JP) | 26/15 R |
| 404034066 | * | 2/1992 | (JP) | 26/15 R |

* cited by examiner

*Primary Examiner*—Amy B. Vanatta
(74) *Attorney, Agent, or Firm*—Kim & Lee; Jerry H. Noh

(57) ABSTRACT

A device for shearing fibers from fabrics comprising a housing and a pair of shearing machines disposed therein. Each shearing machine having a case and a pair of blades, an outer blade and an inner blade secured onto the case. Each blade having a row of spaced teeth. The blades are being operably connected to a motor which moves one or both blades laterally, side to side, in a reciprocating manner to produce a cutting effect on any fibers which come between the teeth. The pair of shearing machines being in a position opposed to one another at a predetermined angle to allow the outer blades of the shearing machines to be substantially coplanar and to allow the teeth of each shearing machine to be aligned adjacent one another. The device further including a vacuum means for suction of cut fabrics and for drawing fabric in between the teeth of the blades.

8 Claims, 2 Drawing Sheets

Fig. 1
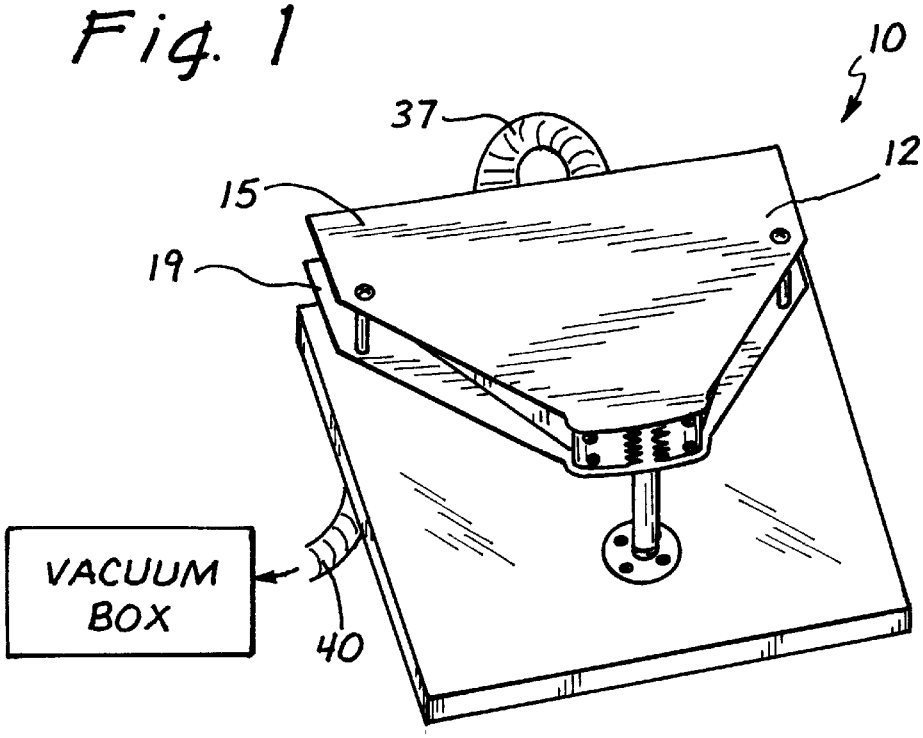
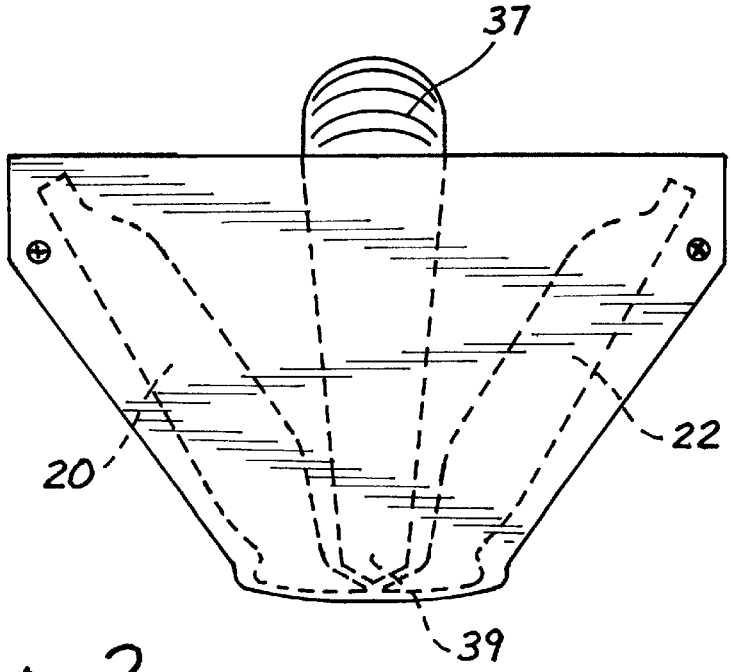
Fig. 2

SHEARING DEVICE

BACKGROUND OF THE INVENTION

1. Field of the Invention

The present invention relates to a shearing device. More particularly, the present invention relates to an improved device for shearing pile fibers from the surface of fabrics.

2. Description of Prior Art

Shearing machines are widely used in the garment manufacturing industry for shearing fibers from the surface of fabrics to produce a clean uniform appearance. There are several varieties of machines used for this purpose known in the art.

One common device has a stationary flat blade and spiral blades contacting the flat blade. The spiral blades are shaped in the form of a helix and are positioned on a cutting cylinder. As the cutting cylinder rotates, the spiral blades rotates and produces a cutting region at the points of contact with the flat blade. Fiber is cut at the cutting region and a suction device removes the cut fibers. One type of such machine is taught in U.S. Pat. No. 5,483,729 issued to Fayard et al. A disadvantage of this type of machine its relatively high cost and ease of breakage.

None of the prior art teaches a device for shearing fibers from fabrics as taught by the present invention.

SUMMARY OF THE INVENTION

The present invention is contrived to overcome the conventional disadvantages. Accordingly, it is an object of the present invention to provide a device for shearing fibers from fabrics sheet which is relatively inexpensive to manufacture and which has increased reliability in terms of breaking down.

The device has a pair of shearing machines secured in a housing between a top sheet member and a bottom sheet member. Each shearing machine has a case and a pair of blades, an outer blade and an inner blade secured onto the case. Each blade has a row of spaced teeth having sharp cutting edges. The blades are on top of one another with the teeth aligned on the same side. The blades are operably connected to a motor which moves one or both blades laterally, side to side, in a reciprocating manner to produce a cutting effect on any fibers which come between the teeth.

The pair of shearing machines are in a position opposed to one another at a predetermined angle so that the outer blades of the shearing machines are substantially coplanar and so that the teeth of each shearing machine are aligned adjacent one another.

The device further includes a vacuum means for suction of cut fabrics and for drawing fabric in between the teeth of the blades.

The outer blades of the shearing machines produces a substantially flat surface, and fabrics having fibers desired to be cut are passed along the surface of the outer blades. Loose fibers are drawn between the teeth of the blades and cut by the reciprocating blades.

Although the present invention is briefly summarized, a fuller understanding of the invention can be obtained by the following drawings, the detailed description and appended claims.

BRIEF DESCRIPTION OF THE DRAWINGS

The present invention will be better understood with reference to the accompanying drawings, wherein:

FIG. 1 is a perspective view of the present invention;

FIG. 2 is a top plan view of the view of the present invention;

DETAILED DESCRIPTION OF THE PREFERRED EMBODIMENTS

Figure 3:
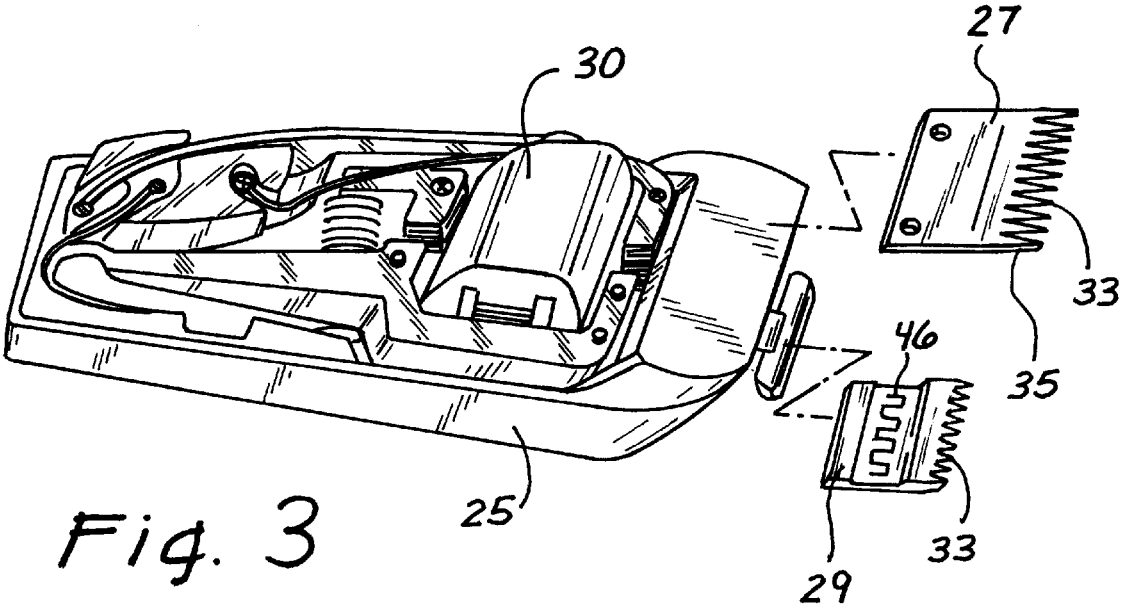
FIG. 3 is an exploded view of the shearing machine of the present invention with the cover of the case removed to show the inner components; and, FIG. 4 is a front elevational view of the present invention.

With reference to the accompanying drawings, a device 10 for shearing fibers from fabric surfaces according to the present invention will now be described.

Referring to FIGS. 1 and 2, the device has a housing 12 comprising a top sheet member 15, a bottom sheet member 19 and having a first shearing machine 20 and a second shearing machine 22 disposed therebetween.

Referring to FIG. 3 each of the shearing machines includes a case 25, an outer blade 27 and an inner blade 29 one or both of which are secured onto the case 25, and an electric motor 30 secured within the case 25. Electric power is supplied to the shearing machine through a power supply such as batteries and line voltage. The motor 30 is of the type found in conventional hair clippers and is well-known in the art. Each blade 27, 29 has a row of spaced teeth 33, and the outer blade 27 is positioned on top of the second blade 29 so that the teeth 33 are aligned on the same side. The teeth 33 have angled side cutting edges 35. In the preferred embodiment, the outer blade 27 is stationary, and the inner blade 29 is pressed against the outer blade 27 by a tension spring (not shown), which allows the inner blade 29 to laterally moved side to side in a reciprocating manner by an eccentric cam (not shown) which is rotatably connected to the motor 30.

The first shearing machine 20 and the second shearing machine 22 should be in a position opposed to one another at a predetermined angle so that the outer blades 27 of the shearing machines 20, 22 are substantially coplanar and so that the teeth 33 of each shearing machine 20, 22 are aligned adjacent one another as shown in FIG. 1.

The device further includes a vacuum means for suction of cut fabrics. A tubing 37 having a first end 39 and second end 40 connects the device to the vacuum means. The vacuum means can be any conventional vacuum box. The first end 39 of the tubing is positioned behind and between the inner blade 29 of the shearing machines 20, 22 within the housing member 12. The second end 40 of the tubing 37 connects to the vacuum box. The vacuum means provides suction for loose fibers on fabrics to be drawn in between the teeth 33 of the blades 27, 29 to be cut. The fibers cut from fabrics are then sucked into the first end 39 of the tubing 37.

Constant prolonged use requires the blades 27, 29 to be lubricated regularly. To increase the duration of lubricant between the blades, a layer of thin steel wiring 46 is placed between the blades 27, 29.

In operation, a fabric having fibers is passed along the outer blades 27 of the shearing machines 20, 22. Loose fibers are drawn between the teeth 33 of the blades 27, 29 and cut by the reciprocating blades. The cut fibers are drawn in the first end 39 of the tubing 37 and then into the vacuum means.

It is important to maintain an air seal between the blades 27, 29 of the shearing machines 20, 22 and the top and bottom sheet members 15, 19 of the housing 12. A tight air seal increases the suction provided by the first end 39 of the tubing 37 to draw fibers in between the teeth 33 of the blades

Figure 4:
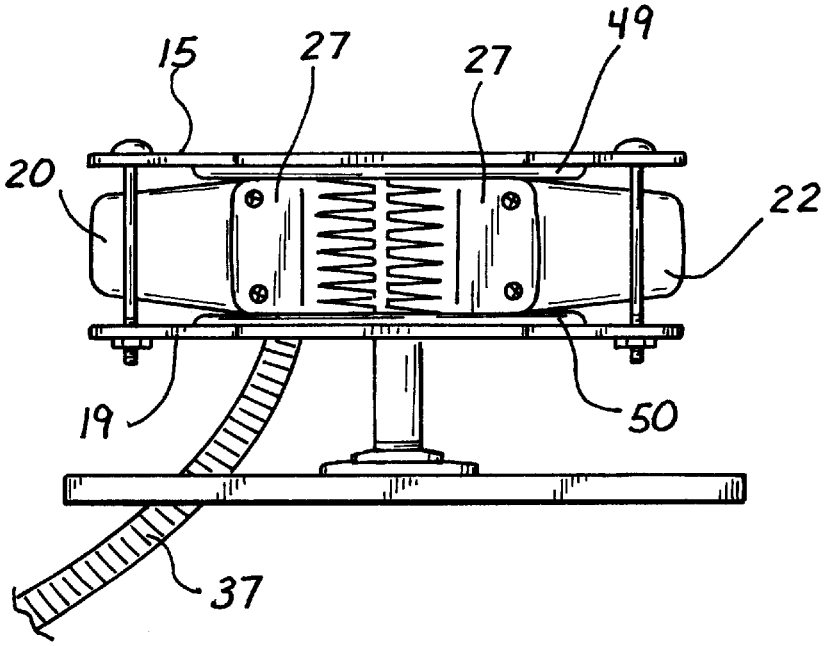

27, 29. A variety of sealing agents known in the art can be placed between the blades and the top and bottom sheet members of the housing. In the preferred embodiment, as shown in FIG. 4, a layer of rubber material 49 is placed between the top sheet member 15 and the shearing machines 20, 22, and a layer of substantially rigid plastic material 50 is placed between the bottom sheet member 19 and the shearing machines 20, 22.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. An improved device for shearing fibers from fabrics comprising:

a first shearing machine and a second shearing machine;

each of said shearing machines having a case, a motor secured inside said case, a power means for operating said motor, an outer blade secured to said case, an inner blade secured to said case, and said motor operably connected to one or both blades for laterally reciprocating one or both blades, each blade having a row of spaced teeth, said blades being placed on top of the other so that the teeth are aligned on the same side; and, a housing member housing said first and second shearing machines, said first shearing machine being opposed to said second shearing machine at a predetermined angle allowing said outer blades of each shearing member to be substantially coplanar and allowing said teeth of said first and second shearing machines to be aligned adjacent one another.

2. A device as described in claim 1 further comprising:

a tubing member having a first end disposed within said housing member in a position behind the inner blades of the shearing machines and a second end attached to a vacuum means; whereby said vacuum means provides suction to draw cut fibers into said first end of said tubing member.

3. A device as described in claim 1 wherein said housing member comprises a top sheet member and a bottom sheet member, said first and second shearing machines being disposed between said sheet members.

4. A device as described in claim 3 further comprising a layer of thin steel wiring disposed between said outer and inner blades of each shearing machine.

5. A device as described in claim 3 further comprising:

a layer of rubber material disposed between said top sheet member and said shearing machines; and, a layer of substantially rigid plastic material disposed between said bottom sheet member and said shearing machines.

6. An improved device for shearing fibers from fabrics comprising:

a top sheet member;

a bottom sheet member;

a first shearing machine and a second shearing machine secured between said sheet members;

each of said shearing machines further comprising:

a case;

a motor secured within said case;

a power means for operating said motor;

an outer blade secured to said case;

an inner blade secured to said case;

each blade having a row of spaced teeth;

said outer blade being placed on top of the second blade so that the teeth are aligned on the same side;

said motor operably engaging one or both blades for laterally reciprocating one or both blades;

said first shearing machine and said second shearing machine being opposed to one another at a predetermined angle allowing said outer blades of said shearing machines to be substantially coplanar and allowing said teeth of each shearing machine to be aligned adjacent one another;

a tubing having a first end disposed behind and between said inner blades of said shearing machines, said tubing having a second end attached to a vacuum means; and, whereby said vacuum means provide suction for cut fibers to be drawn into said first end of said tubing.

7. A device as described in claim 6 further comprising a layer of thin steel wiring disposed between said outer and inner blades of each shearing machine.

8. A device as described in claim 6 further comprising: a layer of rubber material disposed between said top sheet member and said shearing machines; and, a layer of substantially rigid plastic material disposed between said bottom sheet member and said shearing machines.

* * * * *